United States Patent [19]

Nikles, Jr.

[11] 4,403,703

[45] Sep. 13, 1983

[54] GARMENT DISPLAY AND STORAGE UNIT

[76] Inventor: Walter G. Nikles, Jr., 210 Shore Rd., Long Beach, N.Y. 11561

[21] Appl. No.: 231,901

[22] Filed: Feb. 5, 1981

[51] Int. Cl.[3] ..... A47G 29/02

[52] U.S. Cl. ..... 211/193; 248/245; 248/246

[58] Field of Search ..... 211/193, 207; 248/245, 248/222.1, 243, 73

[56] References Cited

U.S. PATENT DOCUMENTS

| | | | |
|---|---|---|---|
| 501,591 | 7/1893 | Richard | 248/246 |
| 844,367 | 2/1907 | Knape | 248/245 |
| 2,937,766 | 5/1960 | Penn | 211/193 |
| 3,245,365 | 4/1966 | Doherty | 248/246 X |
| 3,512,654 | 5/1970 | Olsen et al. | 211/193 |
| 4,156,515 | 5/1979 | Mochly | 211/193 X |

FOREIGN PATENT DOCUMENTS

| | | | |
|---|---|---|---|
| 791726 | 10/1935 | France | 248/245 |
| 1202726 | 7/1959 | France | 248/245 |
| 2296389 | 9/1976 | France | 211/193 |

*Primary Examiner*—William E. Lyddane
*Assistant Examiner*—Peter A. Aschenbrenner
*Attorney, Agent, or Firm*—Michael Ebert

[57] ABSTRACT

A garment display and storage unit which includes modular hanger elements, each constituted by a square slide plate from which is cantilevered an arm provided with a series of hooking posts formed by a peg terminating in a head. The elements cooperate with supporting beams each having a longitudinal channel therein adapted to receive the slide plates, whereby the elements may be shifted to any desired point in the channel and then locked therein by a sliding wedge inserted under the plate. By arranging beams at parallel vertical positions, it becomes possible to erect pairs of hanger elements thereon for supporting an array of garments, each garment being slung between corresponding hooking posts.

13 Claims, 9 Drawing Figures

10
11
13
31
32
32A
32B

GARMENT DISPLAY AND STORAGE UNIT

BACKGROUND OF INVENTION

This invention relates generally to storage and display apparatus for supporting articles of clothing, and more particularly to a storage and display unit in which modular hanger elements function to suspend an array of garments.

The common expedient for suspending a garment from a horizontal bar or rod mounted in a closet or on a rack is the individual clothing hanger made of wood or plastic and consisting of two outstretched arms in a V-formation, the ends of the arms being bridged by a dowel. A hook is attached to the apex of the arms to support the hanger from the bar or rod. When used in conjunction with a sleeved garment such as a coat or jacket, the arms of the hanger are inserted into the shoulders of the garment.

A standard hanger is unsuitable for garments lacking shouldered sleeves, such as undergarments, slips and bras provided with shoulder straps. In recent years, special hangers have been developed with slits or notches in their arms to retain these straps. While it has not been the past practice to suspend bras or slips from hangers, the use of special hangers for this purpose makes it possible to put such undergarments on display in retail establishments to promote sales. Also, it is known to provide clips to attach a garment such as a pair of shorts onto a conventional hanger.

But whether these hangers are of the standard or special type, the use of these hangers, each capable of supporting only a single article of apparel, in the environment of a department store, a boutique or any other retail facility, to display merchandise being sold, has distinct practical drawbacks.

For example, if the need exists for a display of bras in different styles and sizes, it is desirable to be able to hang literally dozens of such bras on individual special hangers which are hooked onto the horizontal rods of racks. In this way, a customer without the need to consult sales personnel may select a suitable bra from this display. And the rack may be wheeled to an appropriate store site.

In the course of a typical business day, many customers can be expected to comb through the racks in search of suitable bras, some customers taking a bra from the hanger in order to try it on and then returning the bra to the hanger should they decide against it. As an almost inevitable consequence of this activity which is often hectic, a rack display which at the outset of the business day was neat and orderly, becomes disordered in various ways, some hangers having been dislodged from the racks and many others being in skewed positions. This disarray is by no means conducive to effective merchandising, particularly in stores featuring goods of high quality.

Moreover, in many instances, it is not possible with commercially available racks to carry more than one level of hangers on each rack. Though the racks may have several tiers of rods to facilitate a stacked display, the tier spaces are predetermined and with relatively large garments it may not be possible to have more than one operative rack tier. Since floor space is at a premium in a retail establishment, the limits imposed by existing display apparatus represents a serious disadvantage.

SUMMARY OF INVENTION

In view of the foregoing, the main object of this invention is to provide a garment storage and display unit adapted to concentrate a large number of garments in a neat and orderly fashion within a relatively small area in a manner compatible with good merchandising practice.

A significant feature of the invention is that the unit makes use of modular hanger elements, each pair of which is adapted to support an array of garments rather than a single garment.

More particularly, an object of this invention is to provide a unit in which an array of garments is supported between a pair of hanger elements cantilevered from supporting beams, each element having a like series of hooking posts thereon, whereby each garment in the array may be slung between corresponding posts on the pair.

Also an object of the invention is to provide a unit of the above type whose modular hanger elements may be oriented on their supporting beams to function either in a hanger mode in which garments are slung between the hooking posts of a pair of elements, or in a rack mode in which each element functions as multiple hooking stations to support a row of standard hangers.

Yet another object of the invention is to provide a floor unit capable of supporting a large display of garments, the unit being rotatable on a floor stand to facilitate garment selection.

Still another object of the invention is to provide a counter top unit rotatable on a counter stand to facilitate selection.

A further object of the invention is to provide a wall-mountable garment storage and display unit.

A salient feature of a unit in accordance with the invention which makes use of modular hanger elements is that the same elements are used regardless of the character of the unit. The units therefore lend themselves to low-cost mass-production and may be manufactured in a disassembled or knockdown kit form. This substantially reduces storage and shipping costs; and because the unit may be readily erected at the site, this creates no practical difficulties. Moreover, because the positions of the modular hanger elements on the beams are adjustable by a simple sliding and locking action, the user of the unit may set up the hanger elements to best suit his garment display requirements.

Briefly stated, in a storage and display unit in accordance with the invention, use is made of modular hanger elements each constituted by a square slide plate from which is cantilevered an arm provided with a series of hooking posts formed by a peg terminating in a head. The elements or modules cooperate with supporting beams each having a longitudinal channel therein adapted to receive the slide plates, whereby each module may be shifted to any desired point in the channel and then locked therein by a slidable wedge which is insertable under the slide plate.

By arranging beams at parallel positions, it becomes possible to set up pairs of modules thereon, an array of garments being supported by each pair, with each garment in the array slung between corresponding hooking posts. By changing the orientation of the modules with respect to the beams, the operating mode of the unit is changed, for in the hanger mode the hooking posts are horizontally disposed to engage the strap loops of garments; whereas in the rack mode, the hooking posts are upright to define multiple hooking stations for accommodating the hooks of standard hangers carrying an array of garments.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

The Basic Components

Figure 1:
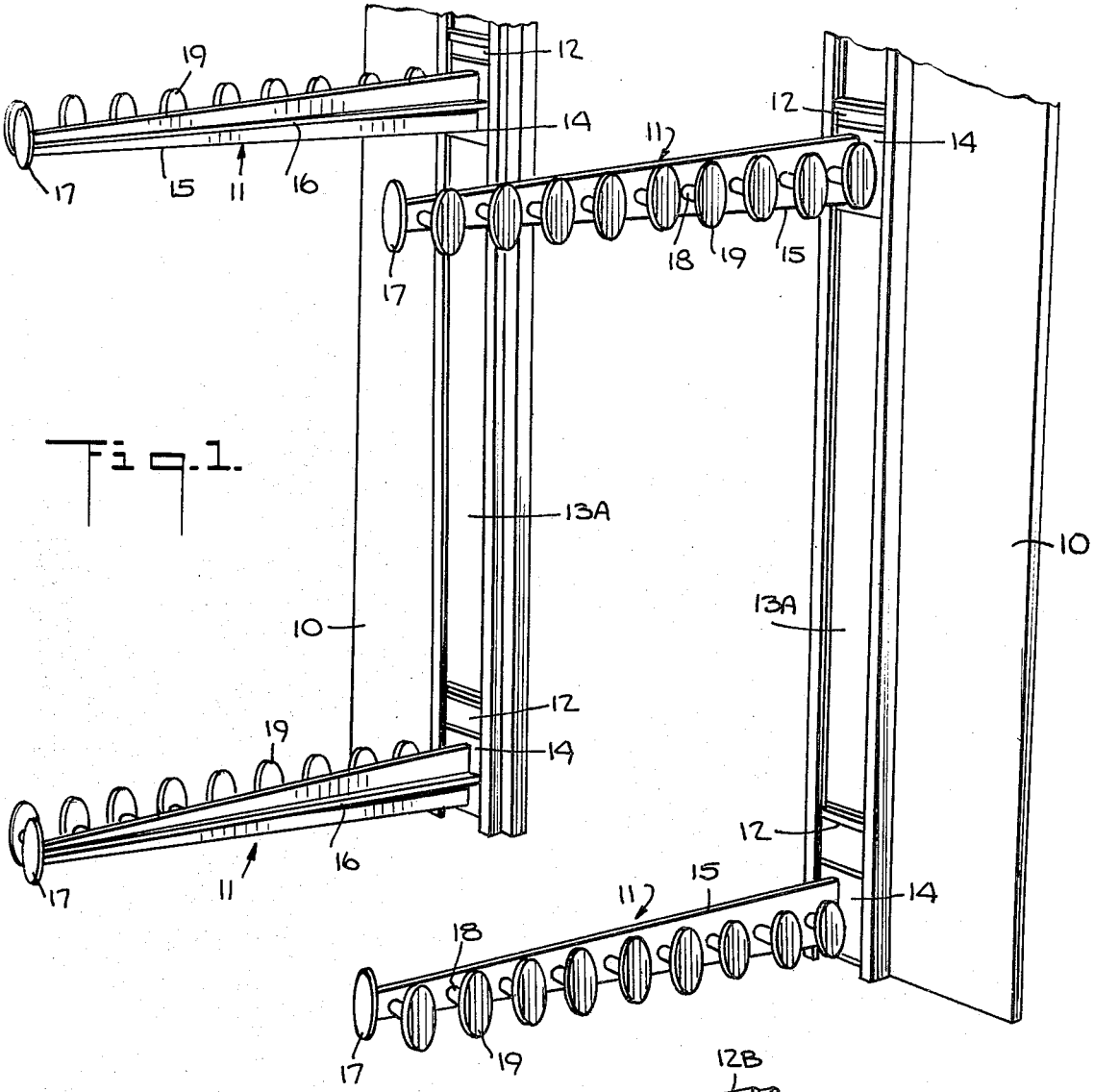
FIG. 1 illustrates in perspective, the basic components of a display and storage unit in accordance with the invention, there being modular hanger elements supporting beams therefor, and wedges to lock the elements on the beams.
Figure 2:
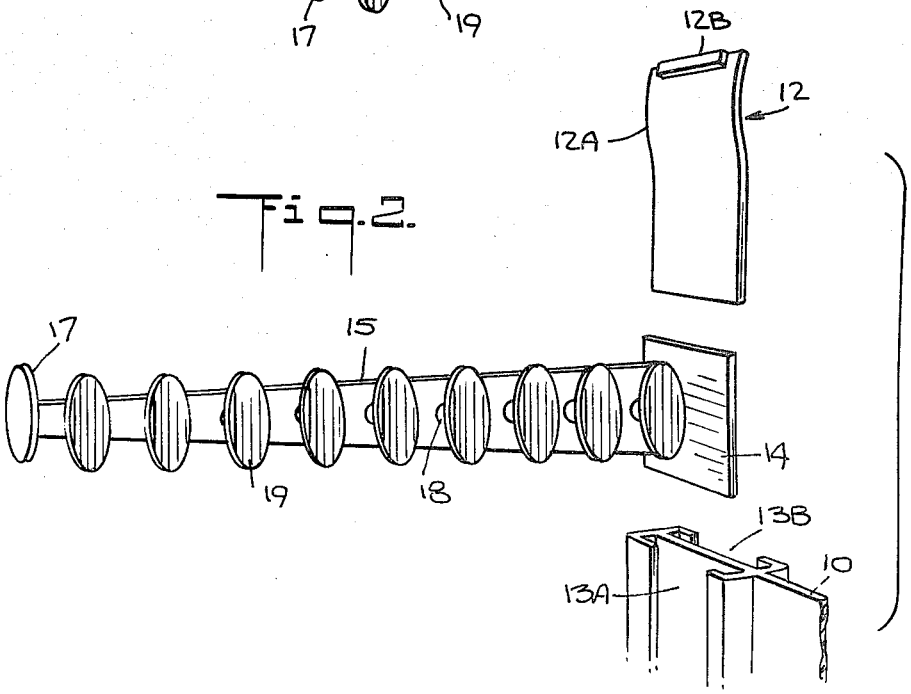
FIG. 2 is an exploded view of the basic components.

Referring now to FIGS. 1 and 2, there are shown the basic components of a storage and display unit in accordance with the invention. These components are beams 10 which, in practice, may take the form of narrow, rigid panels of synthetic plastic material of high structural strength, modular hanger elements or modules 11 and slidable wedge 12. Beams 10 are provided on either face with longitudinally-extending channels 13A and 13B. In some instances, such as where the beams are used for wall mounting a unit, there is a channel only on the outer face, the rear face being secured to the wall.

Each module 11 is constituted by a square slide plate 14 whose dimensions substantially match the width of the beam channels whereby the plate is slidable therein, and a tapered arm 15 cantilevered from the plate, the arm having an underlying reinforcing rib 16 along its longitudinal axis to resist flexure thereof. Arm 15 terminates at its free end in a stop member 17. Anchored on the arm is a series of equi-spaced hooking posts each formed by a peg 18 terminating in a head 19. All of heads 19 as well as stop member 17 are preferably formed of identical oval-shaped pieces to avoid any sharp edges that might snag clothing.

The entire module is preferably formed of transparent synthetic plastic material such as polyvinyl chloride, polypropylene or an acrylic material.

Wedge 12, as best seen in FIG. 2, is formed of a rectangular strip of plastic material which is contoured to define a slight hump 12A adjacent one end, this end having a ledge 12B thereon functioning as a handle. The height of the beam channel is about equal to the combined thickness of slide plate 14 and wedge 12, so that when the wedge is slid under the slide plate and is pushed by its handle to a position in which the raised hump underlies the plate, it then acts to lock the plate in position.

Thus, as shown in FIG. 1, by setting up two vertical beams 10 at parallel positions and by mounting pairs of modules 11 in the parallel channels at selected positions and wedging them in place, one is able to create hanger modules paired at different levels on the beam. It will be seen in FIG. 1 that the orientation of the modules in the beams is such that the hooking posts are normal to the long axis of the beams, this being the hanger mode. However, because the slide plates are square, the modules may be oriented so that the hooking posts are upright, this being the rack mode. The distinctions between these modes will be later explained.

Floor Unit

Figure 3:
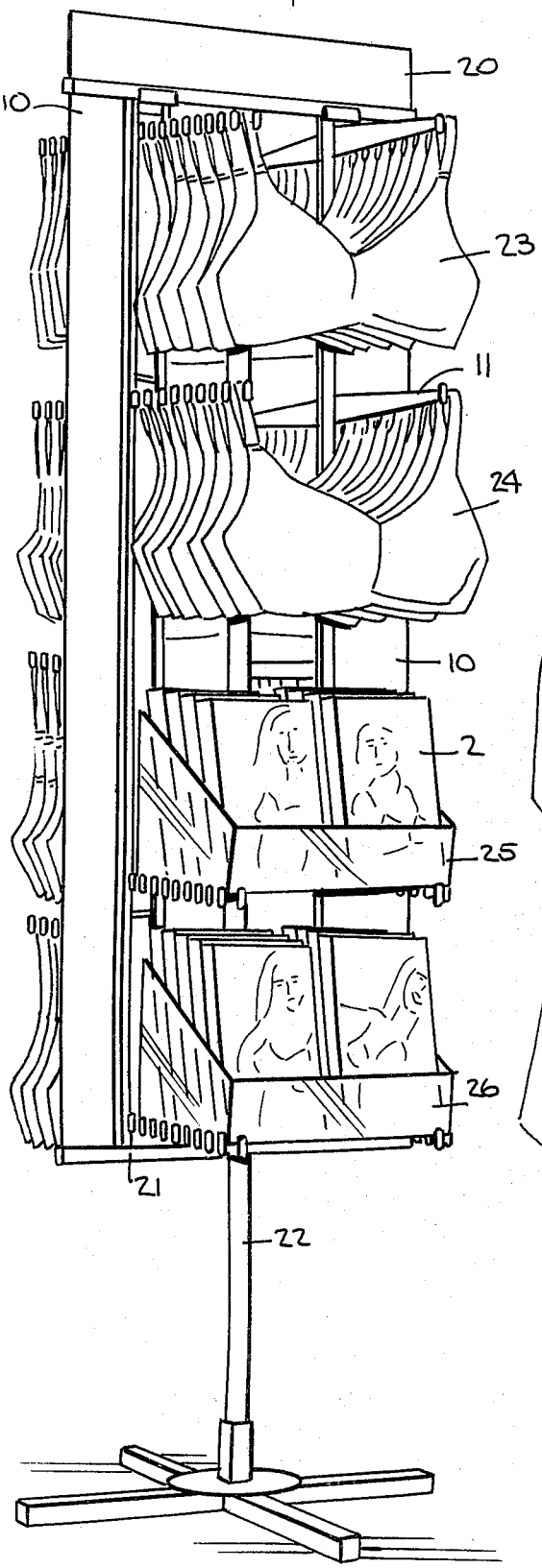
FIG. 3 is a perspective view of a floor unit in accordance with the invention operating in the hanger mode.

Referring now to FIG. 3, there is shown a floor unit in accordance with the invention operating in the hanger mode. The unit includes two beams 10 held at parallel vertical positions by an upper cross beam 20 and a lower cross beam 21 to form a frame which swivels on a floor stand 22.

Beams 11 have channels on either face to receive on opposing sides of the frame four pairs of modules 11 whose hooking posts are normal to the beam axis, this being the hanger mode orientation. On the uppermost front pair of modules 11 and the one below there are supported two arrays of bras 23 and 24, each bra being slung between corresponding hooking posts by means of its straps which are looped over the posts. All four pair of rear modules also support separate arrays of bras.

However, the lowermost front pair of modules and the pair above are not used to support bras, for these modules serve in this instance as brackets to support trays 25 and 26 which contain boxed bras. Thus it is not necessary with a unit in accordance with the invention to remove all bras on sale from their boxes, for some of these boxed bras may be stored on the unit itself. Because the floor unit is rotatable, it may be placed in a confined area, and a customer to obtain access to the garments supported at the rear of the frame, has only to rotate the unit. Rather than supporting trays on modules, as shown in FIG. 3, trays may be directly cantilevered from a pair of beams and locked therein by sliding wedges. To this end, trays are provided (not shown) with a rear wall having a pair of ears projecting therefrom, each ear having a square configuration, similar to a slide plate so that it may be received in a beam channel.

While there is shown a floor unit with only one pair of beams, in practice units may be constructed with a triangular or square frame configuration, each facet of which has a pair of beams to provide a high concentration of garments in a small space.

Figure 4:
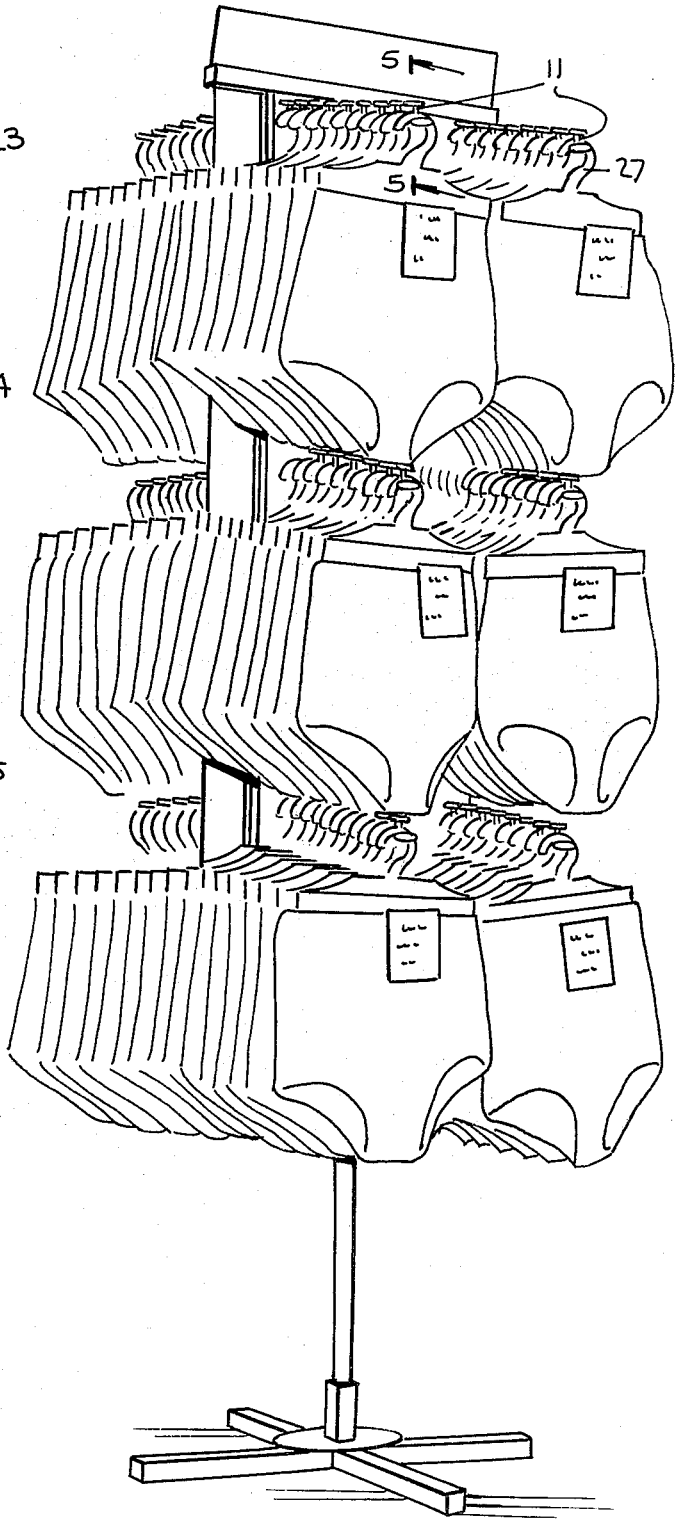
FIG. 4 shows the same floor unit operating in the rack mode.

Referring now to FIG. 4, the same unit is shown; but in this instance modules 11 are oriented with their hooking post upright, so that now each arm affords a series of hooking stations. The unit now operates in the rack mode.

In this mode each arm acts to sustain a row of standard hangers 27 which are illustrated as carrying swim suits that are clipped onto the arms of the hangers.

Thus in the case of swing suits or other garments lacking straps, these cannot be slung from the hooking posts and it is necessary in this instance to use individual hangers to operate in the rack mode. But the unit is more versatile than a conventional rack, for the positions of the modules on the beams are adjustable and may be set to positions accommodating the garments to be suspended thereby by standard hangers.

Counter-Top Unit

Figure 6:
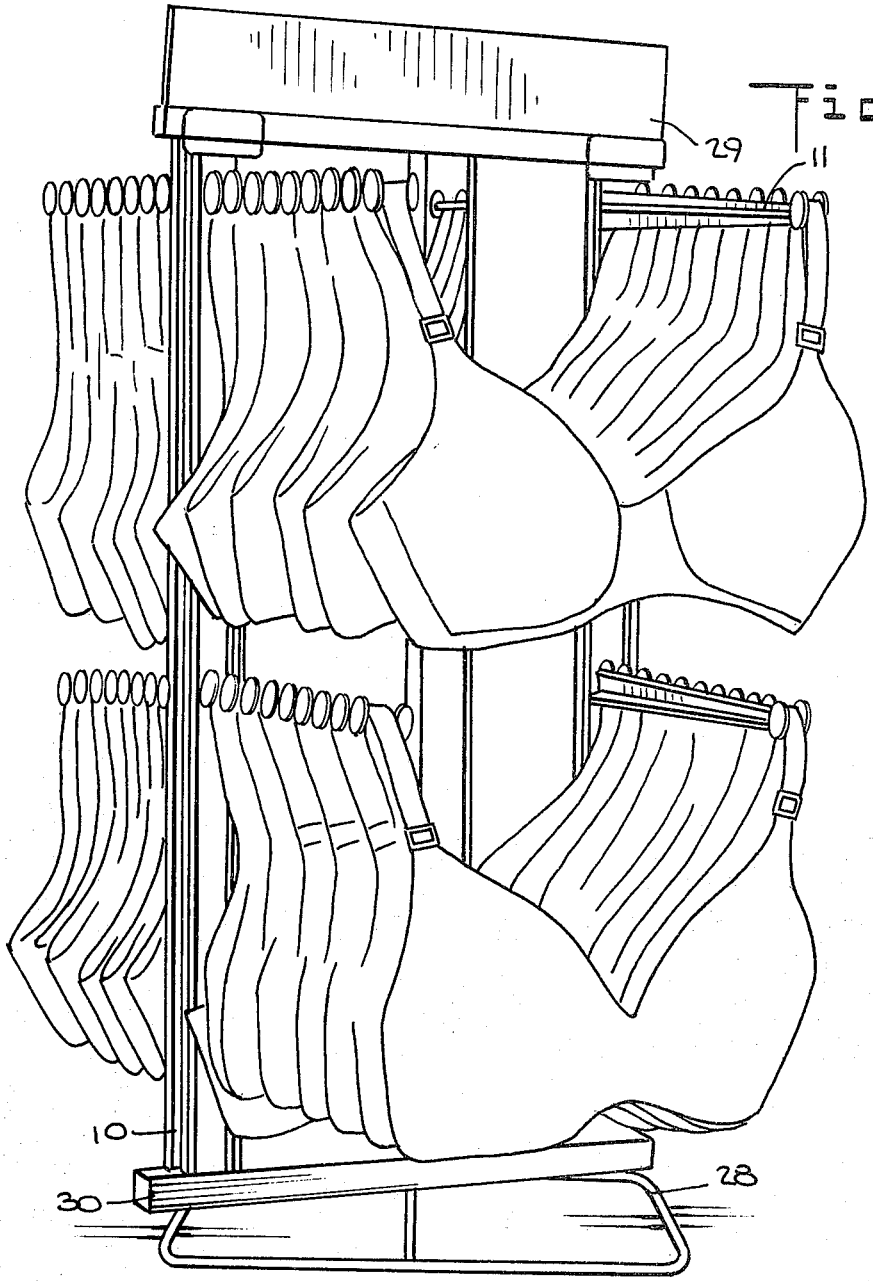
FIG. 6 illustrates, in perspective, a counter-top unit.
Figure 5:
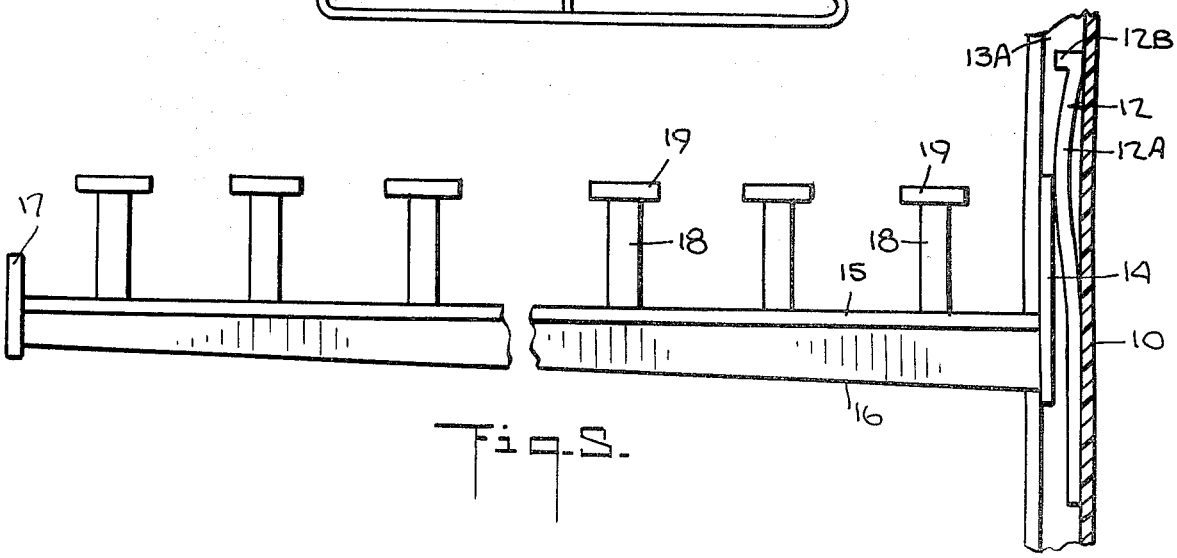
FIG. 5 is a section taken in the plane indicated by line 5—5 in FIG. 4.

In some cases, it may be desirable to place a unit, not on the floor of the retail store, but on a raised counter. A unit for this purpose is shown in FIG. 6, where it will be seen that the unit includes a counter stand 28 on which is swivelled a frame. The frame is composed of a pair of parallel beams 10 bridged by upper and lower cross beams 29 and 30, the beam channels having pairs of modules 11 supported therein from which arrays of bras are suspended.

This unit is shown on the hanger mode and is essentially the same as the floor unit, but for the height of the frame and the nature of the stand. In practice, the counter-top unit may be placed on top of a cabinet in which garments of the type displayed by the unit are stored in box form, so that as bras are taken from the unit, these may be replenished.

Center stand 28 may be joined to the frame by a pole formed of telescoping elements which may be extended or shortened and then locked in place to elevate the frame to the extent dictated by the type of garments supported by the unit.

Wall-Mountable Units

Figures 7, 8, 9:
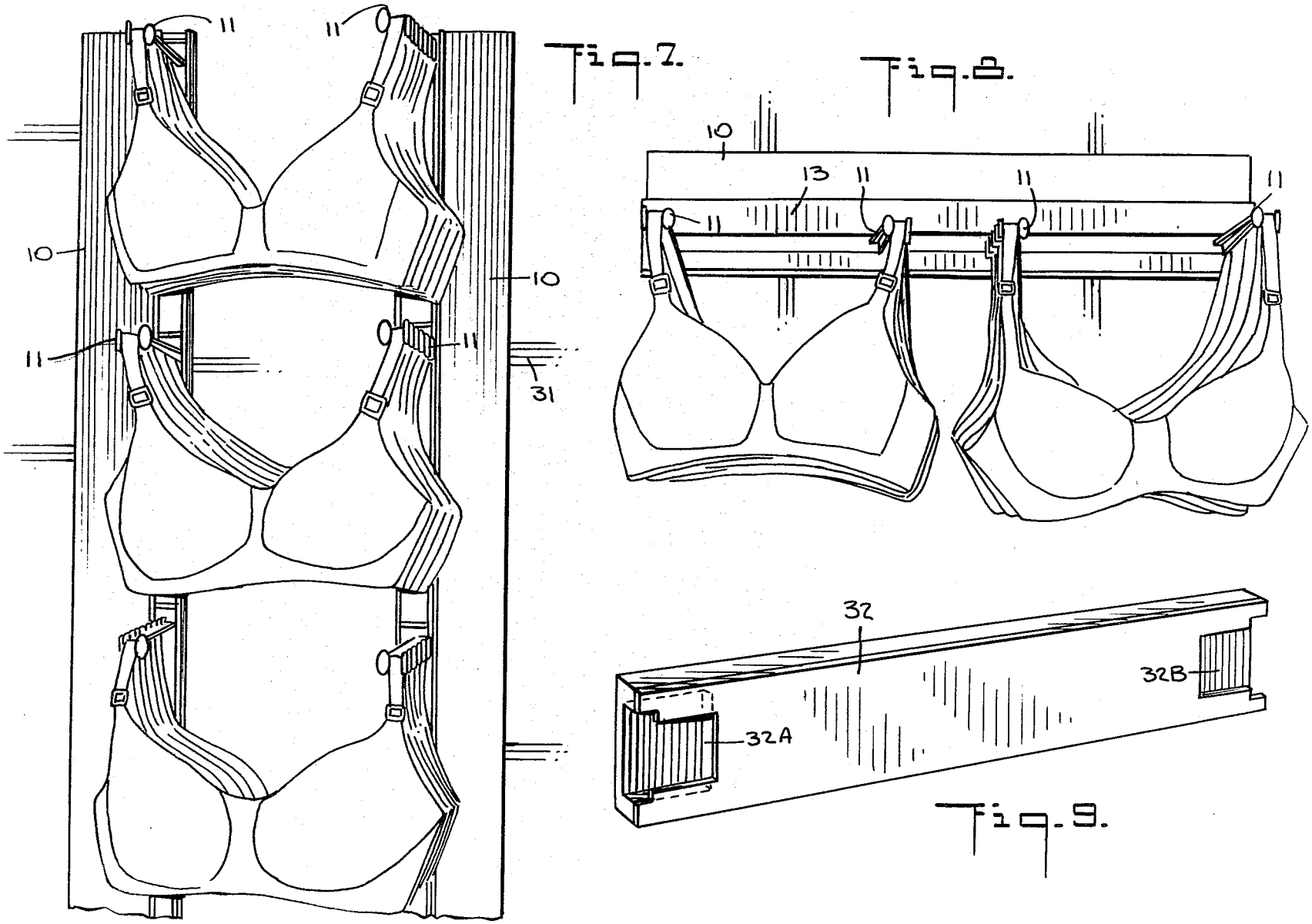
FIG. 7 shows one form of wall-mountable unit.
FIG. 8 shows another form of wall-mountable unit.
FIG. 9 illustrates a beam having end sockets therein to receive a pair of hanger elements.

Referring now to FIG. 7, there is shown a wall-mountable unit formed by two beams 10 which are attached at parallel vertical positions to a wall 31, the unit having several pairs of modules 11 projecting from the beams at different levels. Each pair of modules support an array of bras that are slung between corresponding hooking posts on the modules.

In practice, the beams may be screwed or bolted to the walls. Alternatively, the backs of the beams may be provided with strips of double-faced pressure-sensitive adhesive making it possible to hold the beams to the wall without drilling holes therein.

In all of the units previously illustrated, the module pairs are cantilevered from a pair of parallel vertical beams. In the wall unit shown in FIG. 8, a single beam 10 which is horizontally disposed is attached to the wall, two pairs of modules 11 being cantilevered from the front face channel of the beam. A unit of this type could, for example, be mounted on the back wall of a closet and the modules put into the rack mode so that clothing on conventional hangers could be supported thereby.

In the single beam 32 shown in FIG. 9, the beam is provided at either end with channelled sockets 32A and 32B adapted to form a wall-mountable unit having a single pair of modules. This is usable in the rack mode as a dryer for washed shorts, blouses and skirts that must be hung on hangers to dry. It is, of course, also useful in the hanger mode to support garments slung between the modules. In this arrangement, there is no need for locking wedges, for the downward load imposed on the modules does not act to displace the module as would be the case with vertically extending channels.

For home use, it is desirable when the single beam unit is not in actual use, that the modules normally cantilevered from the end sockets be then arranged to hang down from the beam against the wall. To this end, the spacing between hitching posts on the module arm is such that a pair of such posts are capable of acting in a manner equivalent to a slide plate, so that the post pair may be inserted in a socket, thereby causing the module to hang down and not project forwardly.

Also, modules may be constructed without a series of hitching posts, so that the naked module arm can serve merely as a bracket from which one can suspend various items. Where the object to be suspended is in the form of a goods package having T-shaped slots, the naked module on the beam is oriented with its rib arm up to form an arm having a T-formation compatible with the T-slot in the package, the arms being inserted in the slots to support the package.

While there have been shown and described preferred embodiments of a garment display and storage unit in accordance with the invention, it will be appreciated that many changes and modifications may be made therein without, however, departing from the essential spirit thereof.

I claim:

1. A display and storage unit for garments having shoulder straps as well as garments having shouldered sleeves, the unit comprising:

A. at least one supporting beam having a longitudinally-extending channel on its front face; and B. a plurality of modules, each constituted by a square plate receivable in said channel and an arm cantilevered from the plate, the arm being provided with a series of hooking posts which, when the plate is oriented in the channel so that the posts extend horizontally, function as hooks to engage the strap loops of garments having shoulder straps; and when the plate is oriented in the channel so that the posts are upright, the posts then define a series of stations to hold the hooks of conventional clothes hangers carrying garments having shouldered sleeves.

2. A unit as set forth in claim 1, wherein said unit includes at least one pair of parallel vertical beams each supporting at least one pair of modules.

3. A unit as set forth in claim 2, further including a wedge slidable in said beam channel and adapted for insertion under the slide plate of a module to lock the module in the channel at a desired point therein.

4. A unit as set forth in claim 2, wherein said beams also have channels on the rear face thereof.

5. A unit as set forth in claim 2, wherein said pair of beams are bridged by upper and lower cross beams to form a frame, and a stand to support said frame.

6. A unit as set forth in claim 5, wherein said stand is a floor stand.

7. A unit as set forth in claim 5, wherein said stand is a counter-top stand.

8. A unit as set forth in claim 1, wherein said hooking posts are defined by pegs each terminating at its free end in an enlarged head.

9. A unit as set forth in claim 1, wherein said head has an oval formation.

10. A unit as set forth in claim 1, further including a stop at the free end of the arm.

11. A unit as set forth in claim 1, wherein said arm is of transparent plastic material and is provided on one side with a reinforcing rib.

12. A unit as set forth in claim 1, wherein said beam includes means to secure said beam to a wall.

13. A unit as set forth in claim 12, wherein said unit is constituted by a pair of wall-mountable vertical beams in parallel relation and a plurality of module pairs supported by the beams.

* * * * *